US007403726B2

(12) United States Patent
Shibata

(10) Patent No.: US 7,403,726 B2
(45) Date of Patent: Jul. 22, 2008

(54) IMAGE FORMING APPARATUS

(75) Inventor: Masahiro Shibata, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 232 days.

(21) Appl. No.: 11/429,981

(22) Filed: May 9, 2006

(65) Prior Publication Data

US 2006/0251432 A1 Nov. 9, 2006

(30) Foreign Application Priority Data

May 9, 2005 (JP) ..... 2005/136688

(51) Int. Cl.
*G03G 15/00* (2006.01)

(52) U.S. Cl. ..... 399/44; 399/53; 399/55

(58) Field of Classification Search ..... 399/38, 399/43, 44, 46, 50, 53, 55
See application file for complete search history.

(56) References Cited

U.S. PATENT DOCUMENTS

| | | | | |
|---|---|---|---|---|
| 5,227,842 | A * | 7/1993 | Hayashi et al. | 399/55 |
| 5,543,900 | A * | 8/1996 | Maebashi et al. | 399/176 |
| 6,553,192 | B2 * | 4/2003 | Maebashi | 399/50 |
| 6,941,097 | B2 | 9/2005 | Toba et al. | |
| 6,963,707 | B2 * | 11/2005 | Kinoshita et al. | 399/129 |
| 7,058,326 | B2 * | 6/2006 | Toyama | 399/50 |
| 2004/0190950 | A1 | 9/2004 | Fujita et al. | 399/297 |
| 2005/0063721 | A1 | 3/2005 | Nakayama et al. | 399/49 |
| 2005/0191073 | A1 | 9/2005 | Kawamura et al. | |

FOREIGN PATENT DOCUMENTS

| | | |
|---|---|---|
| JP | 2000-66492 | 3/2000 |
| JP | 2004-163502 A | 6/2004 |
| JP | 2004-163503 | 6/2004 |
| JP | 2004-170654 A | 6/2004 |
| JP | 2005-91932 | 4/2005 |

* cited by examiner

*Primary Examiner*—Hoan H Tran
(74) *Attorney, Agent, or Firm*—Fitzpatrick, Cella, Harper & Scinto

(57) ABSTRACT

An image forming apparatus includes a first image bearing member; a first charger for electrically charging the first image bearing member; a first developer carrying member for carrying a first color developer to develop an electrostatic image formed on the first image bearing member with the first color developer; a first voltage source for applying a first oscillating voltage to the first developer carrying member; a second image bearing member; a second charger for electrically charging the second image bearing member; a second developer carrying member for carrying a second color developer to develop an electrostatic image formed on the second image bearing member with the second color developer; a second voltage source for applying a second oscillating voltage to the second developer carrying member; and a third voltage source for applying a common DC voltage to the first charger and to the second charger, wherein a frequency of the first oscillating voltage and a frequency of the second oscillating voltage are substantially the same.

10 Claims, 9 Drawing Sheets

IMAGE FORMING APPARATUS

FIELD OF THE INVENTION AND RELATED ART

The present invention relates to an image forming apparatus such as an electrophotographic color copying machine, a color printer, etc., which is provided with multiple image bearing members.

In recent years, an electrophotographic image forming apparatus has been continuously reduced in cost, increased in operational speed, increased in the number of functions, and enabled to form a multicolor image. Thus, there are various printers, copying machines, etc., on the market. Among these image forming apparatuses, there are image forming apparatuses of the inline type. An inline image forming apparatus has multiple image forming portions (image formation stations), which are disposed in parallel. In operation, the multiple image formation stations form monochromatic toner images, one for one, different in color. A sheet of transfer medium, for example, a sheet of paper, borne on a transfer belt is sequentially conveyed through each of the multiple image formation stations. While the sheet of recording medium is conveyed through each image formation station, a monochromatic toner image is transferred onto the sheet of recording medium. As a result, multiple monochromatic toner images different in color are deposited in layers on the sheet of transfer medium. An inline image forming apparatus is capable of forming a color image at a high speed. Therefore, it is thought to be promising as the main product in the color printer field.

On the other hand, from the standpoint of the reduction of printer size, a color printer design which vertically aligns multiple image formation units, different in the color of the toner images they form, and conveys the recording medium in the vertical direction with the use of a conveyer belt, is advantageous in that it can reduce a color printer in footprint.

FIG. 9 is a sectional view of a typical inline image forming apparatus in which the recording medium is conveyed in the vertical direction. This image forming apparatus is provided with an endless conveyer belt 980 (which hereinafter will be referred to as ETB), which is disposed within the main assembly of the image forming apparatus so that it runs in the direction indicated by an arrow mark in the drawing. The material for this ETB 980 is film formed of dielectric resin or the like. After being moved out of a sheet feeder cassette (unshown), a transfer medium P is supplied to the ETB 980 by way of a pair of registration rollers (unshown), and then, is conveyed in the direction indicated by the arrow mark X in FIG. 9.

Referring to FIG. 9, generally, an adhesion roller 910 is disposed at the upstream end of the ETB 980, in terms of the rotational direction of the ETB 980. As recording medium such as a sheet of paper or the like is conveyed between the ETB 980, and an adhesion roller 910 to which voltage is being applied, the recording medium is given electric charge, being therefore electrostatically adhered to the ETB 980. In other words, the electrostatic force which adheres the transfer medium to the ETB 980 is effected by the Coulomb attraction between the actual amount of electric charge given to the transfer medium and the mirror electric charge induced on the surface of the ETB 980. This method of conveying recording medium is not limited to an image forming apparatus such as the above described inline image forming apparatus in which the recording medium is vertically conveyed.

The four image formation stations Pa, Pb, Pc, and Pd, which are basically identical in structure, are vertically stacked in parallel.

The image formation stations Pa, Pb, Pc, and Pd are provided with photosensitive drums 901*a*, 901*b*, 901*c*, and 901*d*, respectively, as image bearing members. In the adjacencies of the peripheral surface of each photosensitive drum 901 (901*a*, 901*b*, 901*c*, and 901*d*), a primary charging device 902 (902*a*, 902*b*, 902*c*, and 902*d*) as a charging means, a developing device 903 (903*a*, 903*b*, 903*c*, and 903*d*), a transferring member 904 (904*a*, 904*b*, 904*c*, and 904*d*), and a cleaner 905 (905*a*, 905*b*, 905*c*, and 905*d*) are disposed, respectively. Within the image forming apparatus, an unshown light source apparatus and an unshown polygon mirror are disposed.

Among the four image formation stations Pa, Pb, Pc, and Pd, the image formation station Pa is provided with a rotational photosensitive drum 901*a* in the form of a cylinder. In the adjacencies of the peripheral surface of the photosensitive drum 901*a*, processing means such as the primary charging device 902*a*, the developing apparatus 903*a*, cleaner 905*a*, etc., which make up the image formation station, are disposed. The other image formation stations are similar in structure to the image formation station Pa; they also are provided with the means that make up their image formation stations.

In the developing devices 903*a*, 903*b*, 903*c*, and 903*d*, yellow, magenta, cyan, and black toners are stored, respectively.

The each of the image formation stations Pa, Pb, Pc, and Pd is structured so that the primary charging device 902 (902*a*, 902*b*, 902*c*, and 902*d*) and developing device 903 (903*a*, 903*b*, 903*c*, and 903*d*) can be supplied with electrical voltage as bias.

As an image forming operation is started, first, a monochromatic toner image begins to be formed in the image formation station Pa. That is, a beam of light is projected, while being modulated with the video signals representing the yellow component of an intended color image, by way of the polygon mirror and the like. As a result, an electrostatic latent image is formed on the photosensitive drum 901*a*. To this electrostatic latent image, yellow toner is supplied from the developing device 903*a*, developing the electrostatic latent image into a visible image formed of the yellow toner (which hereafter will be referred to as yellow toner image). As the photosensitive drum 901*a* further rotates, this yellow toner image reaches the transfer area, in which the photosensitive drum 901*a* and ETB 980 are in contact with each other. In the transfer area, the yellow toner image is transferred onto the transfer medium P by the first transfer bias applied to the first image transferring member 904*a*.

The transfer medium P bearing the yellow toner image is conveyed to the image formation station Pb. In the image formation station Pb, a magenta toner image, which has been formed on the photosensitive drum 901*b* through the same process as the above described one before the arrival of the recording medium P at the image formation station Pb, is transferred onto the recording medium P.

Thereafter, the recording medium P is conveyed through the image formation stations Pc and Pd. As the recording medium P is conveyed through the image formation stations Pc and Pd, a cyan toner image and a black toner image are transferred in layers onto the transfer medium P, in the transfer areas of the image formation stations Pc and Pd, respectively.

The residual toner, that is, the toner remaining on the photosensitive drum 901 (901*a*, 901*b*, 901*c*, and 901*d*), is removed by the cleaner 905 (905*a*, 905*b*, 905*c*, and 905*d*), and then, the residual electric charge of the photosensitive drums 901 is removed by a pre-exposing means. As a result, the photosensitive drum 901 (901*a*, 901*b*, 901*c*, and 901*d*) becomes ready to be used for the following image formation.

After the transfer of the toner images, different in color, onto the transfer medium P, the transfer medium P is subjected to heat and pressure in a fixing apparatus 932. As a result, the toner images are fixed to the transfer medium P. Thereafter, the transfer medium P is discharged as a full-color copy onto an external delivery tray (unshown). The fixing apparatus 932 is made up of a fixation roller 951, a pressure roller 952, a heat resistant cleaning member for cleaning the fixation roller 951 and pressure roller 952, a roller heater disposed in the hollow of the fixation roller 951, a roller heater disposed in the hollow of the pressure roller 952, a thermistor for detecting the surface temperature of the pressure roller 952. The detected surface temperature of the pressure roller 952 is used for controlling the fixation roller 951 and pressure roller 952 in temperature, etc.

Also in recent years, from the standpoint of further extending the life of an image forming apparatus to reduce an image forming apparatus in operational cost, and also, from the standpoint of achieving a higher level of image quality, various color image forming apparatuses have been proposed. One of such color image forming apparatuses employs a corona discharging device as a charging apparatus. Its image forming portion is made up of a black image formation station having a developing means which uses two-component developer, and monochromatic color image formation stations having a developing means which uses single-component developer (Japanese Laid-open Patent Application 2004-170654 (P. 2-5; FIG. 1)).

In the case of a jumping developing method, such as the one used by the abovementioned image forming apparatus, which uses nonmagnetic single-component developer, there is no contact between a development sleeve and a photosensitive drum, unlike a contact developing method, in accordance with the prior art, which also uses nonmagnetic single-component developer. Therefore, a jumping developing method can prevent a photosensitive drum from being frictionally worn, being therefore thought to be promising as a developing method for extending the life of a photosensitive drum.

Also in recent years, the ambience in which a printer is used has changed. That is, a printer has come to be used not only in a large office, which usually is properly air-conditioned, as it has been used in the past, but also, in a small office, such as a personal office, for example, a home office, which usually is not as well air-conditioned as a large office. Thus, demand has been increased for an image forming apparatus capable outputting an excellent image regardless of its ambience.

In other words, from the standpoint of the ambience in which an image forming apparatus is used, and also, from the standpoint of media flexibility, a higher level of performance has come to be required of an image forming apparatus such as a printer, a copying machine, etc.

However, it has been known that an image forming apparatus such as the one proposed in the abovementioned patent application suffers from the problem described below. That is, an image forming apparatus such as the above described on uniformly charges the peripheral surface of the photosensitive drum by utilizing corona discharge, being therefore problematic in that it requires high voltage as charge bias, being therefore complicated in the structure of its charging apparatus, and also, generating ozone in its main assembly.

Further, providing each of the image formation stations of an inline color image forming apparatus with a corona discharging device as a charging apparatus makes the cost related to the high voltage for inducing corona discharge extremely high. This is problematic in terms of cost reduction.

As the charging methods different from the above described one which is based on coronal discharge, there are various contact charging methods. The contact charging methods can be roughly divided into two groups, according to the shape of the member used for charging a photosensitive drum. They are the brush-based group and roller-based group.

Also from the standpoint of the voltage applied to a charging member, charging methods may be divided into two groups: a group in which only DC bias is applied to the charging member (which hereafter will be referred to as DC-based charging method), and a group in which the combination of DC bias and AC bias is applied to the charging member (which hereafter will be referred to AC-based charging method). An AC-based charging method is characterized in that generally, an AC-based charging method can more uniformly charge an object than a DC-based charging method.

It has already been stated that the merits of a contact charging method are that a contact charging method is smaller in the amount of ozone generation and the number of the structural components of a charging apparatus, and is lower in cost. In terms of the damage inflicted upon a photosensitive drum, the AC-based charging method is greater than a charging method based on corona discharge. The effects of this characteristic of the AC-based charging method is very conspicuous when the AC-based charging method is used with a photosensitive drum based on OPC.

Further, the amount of the damage inflicted upon a photosensitive drum when the AC-based charging method is used is affected by the voltage applied to a charging member; the greater the applied voltage, the greater the damage. It has been discovered that a charging operation in which the combination of DC and AC biases is applied while an OPC-based photosensitive drum is rotated is several times greater, in the amount of the damage inflicted upon a photosensitive drum, than a charging operation in which only DC voltage is applied while an OPC-based photosensitive drum is rotated.

Using the DC-based charging method makes it possible to simplify a charging apparatus. Further, because of the structure of an inline image forming apparatus, using the DC-based charging method makes it possible to reduce to one, the number of the electric power sources for supplying the image formation units with DC bias, making it therefore possible to make further progress in terms of the reduction of image forming apparatus cost.

Further, in the case of a jumping developing method which uses nonmagnetic single-component developer, there is no contact between a development sleeve and a photosensitive drum, unlike a contact developing method, in accordance with the prior art, which uses nonmagnetic single-component developer. Therefore, a jumping developing method which uses nonmagnetic single-component developer can prevent a photosensitive drum from being frictionally worn, making it possible to extend the life of a photosensitive member. Therefore, it can reduce an image forming apparatus in cost.

However, in the case of the image forming apparatus, disclosed in Japanese Laid-open Patent Application 2004-170654, which is provided with a developing device for forming a monochromatic black toner image on one of the photosensitive drums, and three other developing devices for forming three monochromatic toner images, different in color, on the rest of the photosensitive drums, one for one, the developing device for forming a black toner image uses two-component developer, whereas each of the developing devices for forming monochromatic color toner images different in color uses a jumping developing method and nonmagnetic single-component developer. In other words, this image forming apparatus employs two different developing methods, being therefore complicated in structure. Further, the employment of two different developing methods is not unlikely to have adverse effects on cost reduction.

Color reproducibility is dependent upon toner characteristics. Thus, in the case of an image forming apparatus, the color developing devices of which employ a jumping developing method which uses nonmagnetic single-component developer, it is common practice to adjust the development bias, which in this case is the combination of DC and AC voltages, in order to form an image which is excellent in terms of color reproduction.

The density and uniformity of the toner are very important for color reproduction. Therefore, the density and uniformity of the toner on the peripheral surface of each photosensitive drum is particularly important in terms of the level of image quality at which an image is outputted.

Further, an image forming apparatus can be stabilized in terms of the level of quality at which it outputs an image, by adjusting the development bias according to the conditions of the ambience in which the image forming apparatus is used.

For example, an image forming apparatus in which all the photosensitive drums in the image formation stations for forming yellow (Y), magenta (M), cyan (C), and black (BK) toner images were charged to −500 V by the corresponding charging apparatuses connected to a single high voltage DC power source, and the electrostatic latent images formed on the photosensitive drums were developed by the developing devices which used a jumping developing method and nonmagnetic single-component developer and were identical in development bias, sometimes failed to yield an image which was satisfactory in terms of image density (uniformity in toner density), proving that when all the developing devices are identical in development bias, it is impossible to always form an image satisfactory in density (uniformity in toner density).

For example, to all the development sleeves, the combination of a DC voltage, as DC bias, which is −400 V in amplitude, and an AC voltage, as AC bias, which is 3 kHz in frequency, 1.7 kV (Vpp) in peak-to-peak voltage, rectangular in waveform, and 50% in duty ratio is applied.

Table 1 given below shows the image density levels which resulted when all the developing devices were the identical in the development bias applied to the development sleeve.

TABLE 1

| Color | Y | M | C | Bk |
|---|---|---|---|---|
| Density | E | F | N | E |

Legend for image density levels:
E: excellent in density uniformity
G: good in density uniformity
F: slightly unsatisfactory in density uniformity
N: unsatisfactory in density uniformity.

The examination of the results revealed that in order to make all of the yellow (Y), magenta (M), cyan (C), and black (BK) toner image formation stations to achieve the optimal image density, it is desired that the image formation stations are rendered different in developer bias; each developing device is supplied with a development bias unique to the developing device.

The examination also made it possible to hypothesize that the causes of the problems which occurred when the image formation stations were rendered different in development bias are as follows:

That is, the following was revealed: The size reduction of the image forming apparatus allowed the AC component of development bias applied to a given image formation station to induce alternating electric current to flow in the DC generation circuit of the charging apparatus of the image forming apparatus. As a result, in addition to the DC voltage as the charge bias, AC voltage was applied to the charging device. As the AC bias flowed into the charging device as described above, minute changes, which correspond to the frequency of the AC component of the development bias applied to each image formation station, occurred to the potential level to which the peripheral surface of the photosensitive drum was charged. Further, rendering the image formation stations different in the frequency of the AC component of the development bias induced multiple AC currents in the DC generation circuit of the charging device, and the multiple AC currents interfered with each other. These minute changes in the potential level of the photosensitive drum, and the interferences among the AC currents induced in the DC generation circuit of the charging device, sometimes caused the image forming apparatus to output defective images such as an image which is irregular in pitch, an image which suffers from moire, and the like.

In other words, it is possible to hypothesize the following: Flowing of this AC voltage as the development bias into the charging apparatus turns the DC-based charging method into a pseudo AC-based charging method. As a result, the peripheral surface of the photosensitive drum is charged in the pattern of moire.

In order to prevent this AC component of the development bias from inducing AC current in the DC generation circuit of the charging device, it is necessary to provide the DC generation circuit with a protective resistor with a sufficient amount of electrical resistance. This raises the fear of cost increase.

SUMMARY OF THE INVENTION

The primary object of the present invention is to provide an image forming apparatus which is no greater in size and no higher in cost than an image forming apparatus in accordance with the prior art, and yet, is capable of reliably forming an image which is higher in quality, in particular, in terms of sharpness and vividness, than an image which an image forming apparatus in accordance with the prior art forms.

Another object of the present invention is to provide an image forming apparatus having multiple image bearing members.

Another object of the present invention is to provide an image forming apparatus capable of supplying each of its image formation stations with a development bias which is different from the development bias supplied to the other image formation stations.

Another object of the present invention is to provide an image forming apparatus which does not form an image suffering from moire.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Next, referring to FIGS. 1-7, the image forming apparatus in the first embodiment of the present invention will be described.

Figure 1:
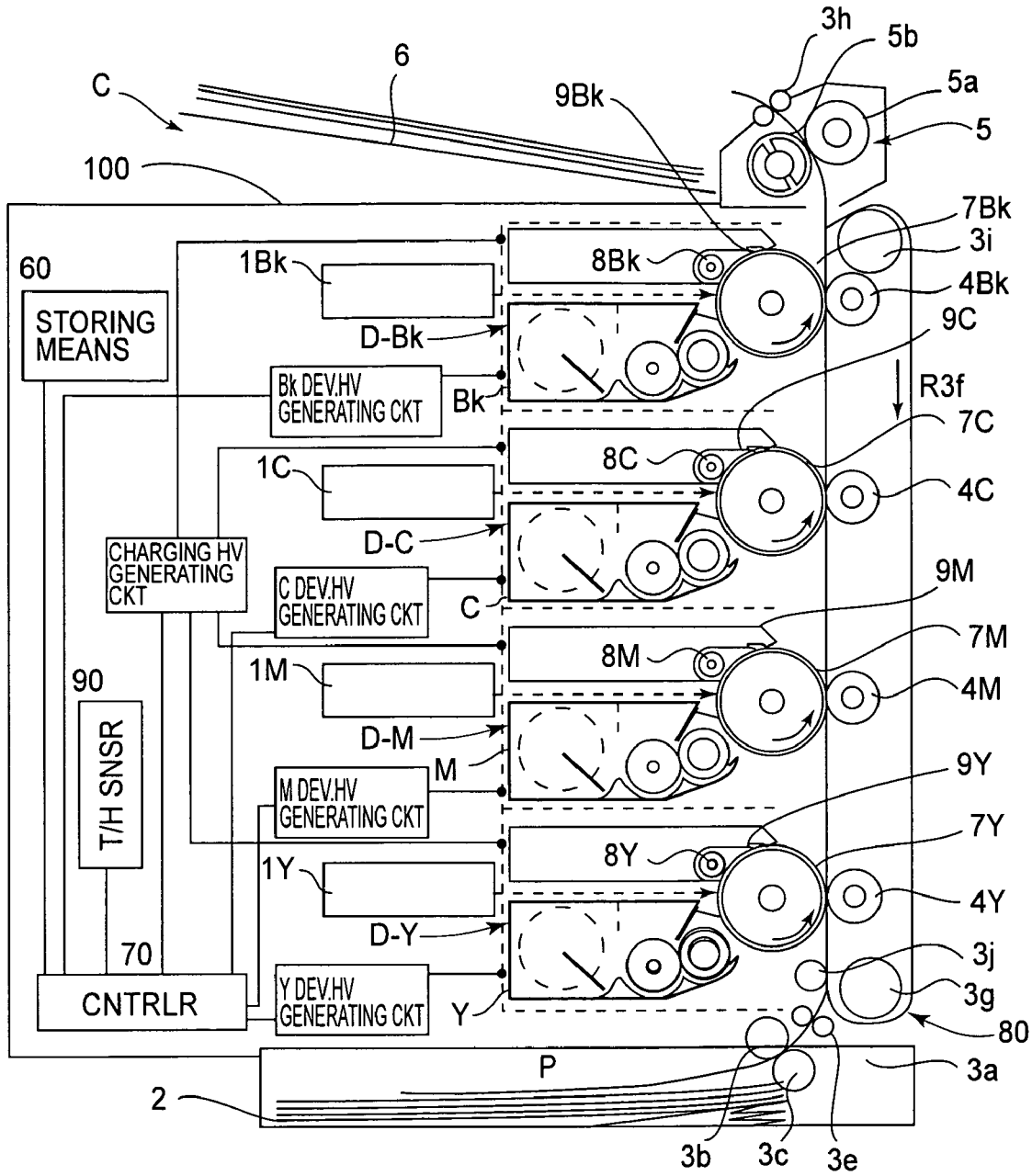
FIG. 1 is a schematic sectional view of the image forming apparatus in the first embodiment of the present invention.

FIG. 1 is a schematic sectional view of the color image forming apparatus 100 (copying machine or laser printer) which employs an electrophotographic process. The image forming apparatus 100 is provided with four color image formation stations, which correspond to four colors, that is, yellow (Y), magenta (M), cyan (C), and black (Bk), one for one. The four color image formation stations are independent from each other and are vertically stacked in parallel. The yellow (Y), magenta (M), cyan (C), and black (Bk) image forming stations are provided with first to fourth photosensitive drums (image bearing member), respectively. Further, each color image formation station is provided with a developing device and a cleaning apparatus. The color image forming apparatus 100 is structured to yield a full-color image by transferring four monochromatic images different in color onto a transfer medium P (sheet of transfer medium) which is being conveyed while remaining adhered to an ETB 80 by an adhesion roller 3J.

In this embodiment, in order to minimize the image forming apparatus 100 in footprint, and also, to make it possible for the cartridges to be replaced, or paper jam to be dealt with, by opening only the front door of the apparatus, the image forming apparatus 100 is structured so that the cartridges in which the structural components of an image formation unit are integrally disposed are vertically stacked, and also, so that the main assembly of the image forming apparatus 100 is separable into two portions, that is, the portion comprising the cartridges and the portion comprising the ETB 80.

Because of the above described structural arrangement, the transfer medium P is conveyed upward against gravity. Therefore, the transfer medium P such as a sheet of paper needs to remain properly adhered to the ETB 80. Thus, transfer rollers 4Y, 4M, 4C, and 4Bk are attached to a transfer roller mount (unshown), which is kept pressured toward the ETB 80 by springs. The amount of pressure by which transfer rollers 4Y, 4M, 4C, and 4Bk are kept pressed against the corresponding photosensitive drums is regulated.

The adhesion roller 3J is disposed in the adjacencies of the location at which the transfer medium P comes into contact with the ETB 80. As bias is applied to the adhesion roller 3J, the transfer medium P is given electric charge, being thereby adhered to the ETB 80 so that it can be conveyed by the ETB 80 while remaining adhered to the ETB 80.

Designated by referential symbols 7Y, 7M, 7C, 7Bk are the first to fourth electrophotographic photosensitive members (which hereafter will be referred to as photosensitive drums), which are in the form of a rotatable drum and are repeatedly used as image bearing members. The photosensitive drums 7Y, 7M, 7C, and 7Bk are rotationally driven in the counterclockwise direction indicated by an arrow mark, at a preset peripheral velocity (process speed). They are 30 mm in diameter, and are based on an organic photo conductor which is inherently negative in polarity. In this embodiment, the process speed of the image forming apparatus is 100 mm/sec.

As the photosensitive drums 7Y, 7M, 7C, and 7Bk are rotated, they are uniformly charged by the charge rollers 8Y, 8M, 8C, and 8Bk as the first to fourth charging devices to preset polarity and potential level, and their charged portions are exposed by exposing means 1Y, 1M, 1C, and 1Bk (comprising: a laser diode; a polygon scanner; a lens group; etc.). As a result, electrostatic latent images corresponding to first to fourth color components (yellow, magenta, cyan, and black components, for example) are formed by the color image formation units.

Figure 2:
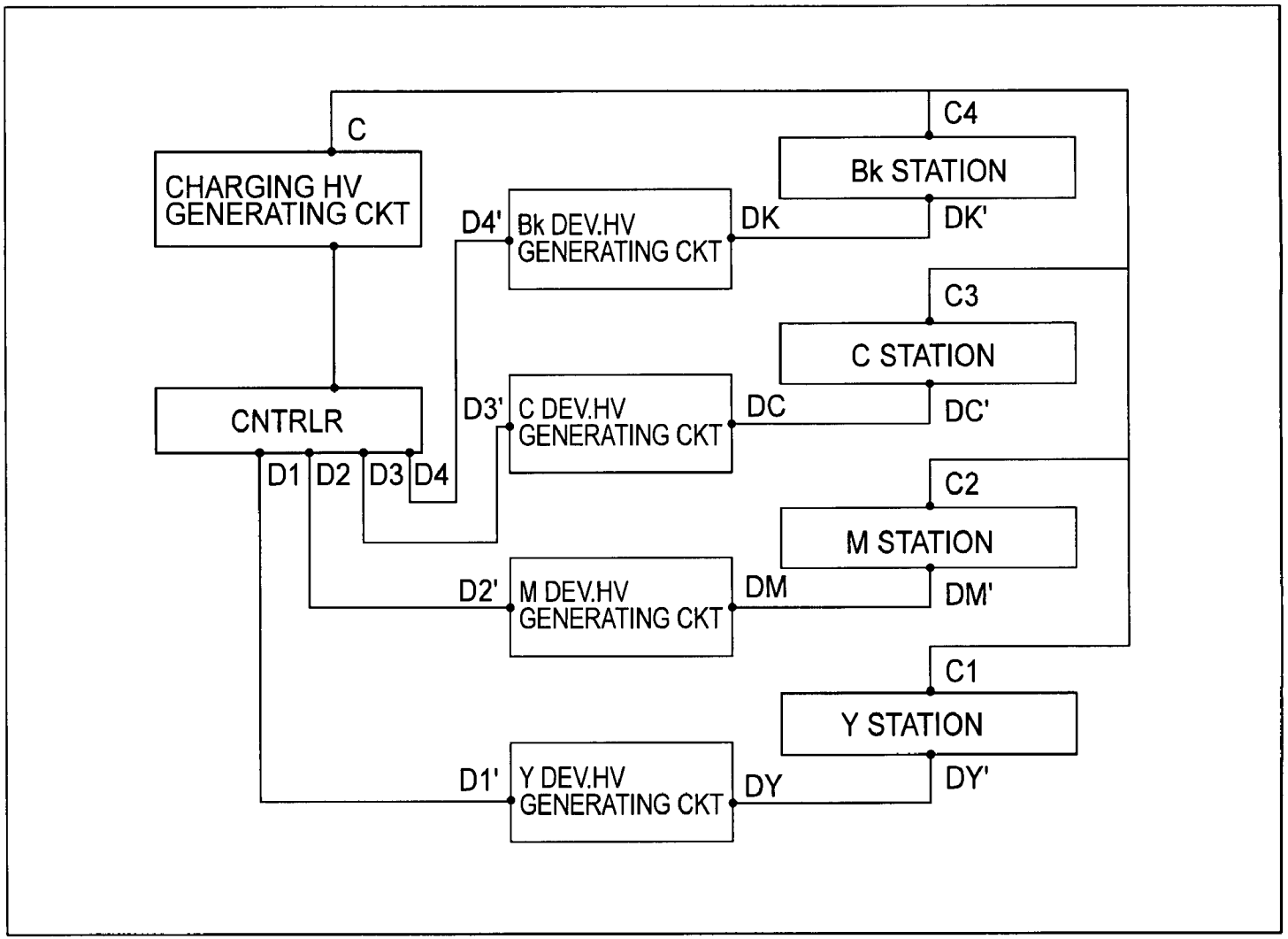
FIG. 2 is a block diagram of an image forming apparatus in the first embodiment.

Next, referring to FIG. 2, which is a block diagram of the portions of the image forming apparatus, which are related to the charging apparatus, the charging apparatus in this embodiment will be described. The high voltage generation circuit, as a voltage supply portion (electric power source) of the charging apparatus is electrically connected to the controller, so that as an image forming operation is started, the controller begins to make the charging high voltage generating circuit of the charging apparatus generate the charging high voltage. The image forming apparatus is provided with only a single charging high voltage generating circuit, which is designed to supply all the color stations (Y, M, C, and Bk) as image formation stations with electric power. As will be evident from FIG. 2, the charging high voltage generating circuit is provided with an electrical contact C, whereas the color stations (Y, M, C, and Bk) are provided with electrical contacts C1, C2, C3, and C4, respectively.

With the employment of the above described structural arrangement, common voltage can be applied to the charge rollers 8Y, 8M, 8C, and 8Bk of the yellow (Y), magenta (M), cyan (C), and black (Bk) image formation portions, respectively, by the charging high voltage generating circuit, which is the only high voltage power source of the charging apparatus.

In this embodiment, −1.0 kV of DC voltage is applied by the charging high voltage generation circuit, which is the only high voltage power source of the charging apparatus. The charging method in this embodiment is one of the DC-based contact charging methods. More specifically, the charge rollers, which are $1\times10^6$ Ω in actual electrical resistance, are placed in contact with the photosensitive drums 7Y, 7M, 7C, and 7Bk with the application of a total pressure of 9.8 N so that the charge rollers are rotated by the rotation of the photosensitive drums. The peripheral surfaces of the photosensitive drums 7Y, 7M, 7C, and 7Bk are uniformly charged to −500 V. Each charge roller charges the corresponding photosensitive drum through electrical discharge.

Each of the exposing means 1Y, 1M, 1C, and 1Bk used in this embodiment to form electrostatic latent images is a polygon scanner which uses a laser diode. It forms an electrostatic latent image by focusing the beam of laser light it projects while modulating the beam of light with video signals, on the peripheral surface of the photosensitive drum (7Y, 7M, 7C, and 7Bk).

As a given point of the peripheral surface of each photosensitive drum (7Y, 7M, 7C, and 7Bk) is exposed, its electrical potential level V1 changes to −120 V (light point potential level). As a result, an electrostatic latent image is effected on the peripheral surface of the photosensitive drum (7Y, 7M, 7C, and 7Bk). The point of the peripheral surface of the photosensitive drum 7, at which the beam of laser light is made to start writing is as follows. In terms of the primary scan direction (direction perpendicular to forward movement of transfer medium P), the writing is started at the point which corresponds to a positioning signal called BD, outputted from the polygon scanner per scanning line. In terms of the secondary scan direction (direction parallel to forward movement of transfer medium P), the writing is started by the point TOP signal, which is triggered by a switch disposed in the transfer medium conveyance path. With the employment of this setup, the exposure of the peripheral surface of each photosensitive drum 7 is started so that the four photosensitive drums 7 become identical in terms of the positional relationship between the exposure starting point and the transfer medium P.

Next, the electrostatic latent images on the photosensitive drums 7Y, 7M, 7C, and 7Bk are developed by the developing apparatuses D-Y, D-M, D-C, and D-Bk of the image formation stations (Y, M, C, and Bk), respectively, which are different in the color of the developer they use.

The yellow (Y), magenta (M), cyan (C), and black (Bk) developers used in this embodiment are nonmagnetic single-component developers, that is, developers which do not contain magnetic substance. They are used for development in combination with the jumping developing method.

Each of the developing apparatuses D-Y, D-M, D-C, and D-Bk has a development sleeve, which rotates in the same direction as the photosensitive drums 7Y, 7M, 7C, and 7Bk, at 170% of the peripheral velocities of the photosensitive drums 7Y, 7M, 7C, and 7Bk, respectively. The electrostatic latent images are developed by the development sleeves to which voltage is being applied. The voltage applied to the development sleeves can be varied by the signal from the controller 70.

The ETB 80 is circularly driven in the direction indicated by an arrow mark at the same velocity as the peripheral velocity of the photosensitive drum 7 (7Y, 7M, 7C, and 7Bk). The ETB 80 is a 130 μm thick mono-layer resin belt, and is formed of PET (polyethylene terephthalate) in which carbon black has been dispersed for the adjustment of electric resistance to $1\times10^{10}$ Ω. It is provided with ribs adhered to its inward surface, in terms of the loop it forms, to prevent it from snaking, or deviating in position.

As the transfer rollers 4Y, 4M, 4C, and 4Bk as image transferring members, four rollers formed of spongy urethane rubber, the volume resistivity of which has been adjusted to $10^{5}$ Ω, and which can withstand high voltage, are employed. They are in contact with the portions of the inward surface of the ETB 80, which correspond in position to the nips, one for one, between the photosensitive drums 7Y, 7M, 7C, and 7Bk and the ETB 80.

After being fed into the image forming apparatus main assembly from the transfer medium cassette 3*a*, the recording medium P is moved past a pair of registration rollers 3*e*, and is guided by the transfer station entrance guides, being thereby placed in contact with the ETB 80.

Then, the transfer medium P adhered to the ETB 80 is sequentially conveyed through the image formation stations, in which the image formation units are positioned. As the transfer medium P is conveyed through each image formation station, the toner image on the photosensitive drum 7 (7Y, 7M, 7C, and 7Bk), which is different in color from the toners images on the other photosensitive drums, is transferred onto the transfer medium P. As a result, a full-color image is effected on the transfer medium P.

After the transfer of all the toner images different in color, the transfer medium P is separated from the ETB 80 by the curvature of the belt, at the top end of the belt loop. Then, it is conveyed to a fixing device 5 (which is made up of pair of fixation rollers 5*a* and 5*b*). In the fixing device 5, the toner images on the transfer medium P are thermally fixed to the transfer medium P, yielding thereby a permanent print. Thereafter, the transfer medium P is discharged from the image forming apparatus main assembly.

After the transfer of the toner image from each photosensitive drum 7 (7Y, 7M, 7C, and 7Bk), the photosensitive drum 7 is cleaned by the cleaning blade 9 (9Y, 9M, 9C, and 9Bk); the transfer residual toner, that is, the toner remaining on the peripheral surface of the photosensitive drum 7, is scraped away by the cleaning blade 9, preparing thereby the photosensitive drum 7 for the next image formation.

In this embodiment, the image forming apparatus is provided with a storage means 60, which is one of the components that characterize this embodiment. As the storage means 60, a nonvolatile memory is employed. The storage means 60 is connected to the controller 70. In the storage means 60, the information for discriminating in color information, the four image formation stations of the image forming apparatus 100 is stored, making it possible for the AC component of the development bias for each image formation station to be set independently from those for the other image formation stations.

The storage means 60 is capable of storing the information regarding the cumulative number of the transfer mediums which have been used for image formation in each image formation station. In this embodiment, it is the cumulative number of transfer mediums used for image formation that is stored in the storage means 60. However, information other than the cumulative number of transfer mediums may be stored in the storage means 60; for example, the cumulative length of time each development sleeve has been rotated, the number of times the image forming operation is carried out, etc. In other words, it is the information regarding the history of the usage of the image forming apparatus that is stored in the storage means 60.

Further, in this embodiment, the image forming apparatus 100 is provided with an ambient condition detecting means for detecting the condition of the ambience in which the image forming apparatus is being operated, being enabled to detect the internal temperature and humidity of the image forming apparatus 100.

The image forming apparatus 100 in this embodiment is structured so that if the controller 70 determines, based on the information stored in the storage means 60, and the ambience information detected by the ambience detecting means, that there is the possibility that images which are abnormal in density, for example, images which are conspicuously low or high in density, will be yielded, the AC component of the development bias supplied to a given image formation station can be adjusted independently from those to be supplied to the other image formation stations.

As for the properties of the ambience, which are to be detected by the ambience condition detecting means, the ambient humidity can be estimated from the amount of changes in the electrical resistance of the transfer roller, because the electrical resistance of the transfer roller is affected by the ambient humidity. That is, the condition of the ambience can be detected (estimated) by detecting the amount of voltage required to cause a preset amount of electric current to flow through the transfer roller, or by detecting the amount of electric current flowing through the transfer roller while a preset amount of voltage is applied to the transfer roller. This method of detecting the ambient conditions does not require the image forming apparatus to be provided with a detecting means dedicated to the detection of the ambient conditions, preventing thereby cost increase.

A printer such as a graphic printer which requires a high level of image quality needs to be equipped with a charging member (charging members) which is small in the amount by which its electric resistance value is affected by the changes in the ambient conditions. Thus, its charging member is inaccurate as the ambient condition detecting means. Therefore, when it is necessary to detect the ambient conditions at a high level of accuracy, a temperature/humidity sensor 90 is preferable as the ambient condition detecting means. In this embodiment, the temperature/humidity sensor 90 is employed. However, an ambient condition detecting means other than the temperature/humidity sensor 90 may be used to detect the information regarding the interior of the image forming apparatus.

Next, referring to FIG. 3, the developing apparatus 10 of each image formation station, which uses the jumping developing method and nonmagnetic single-component developer, will be described.

Figure 3:
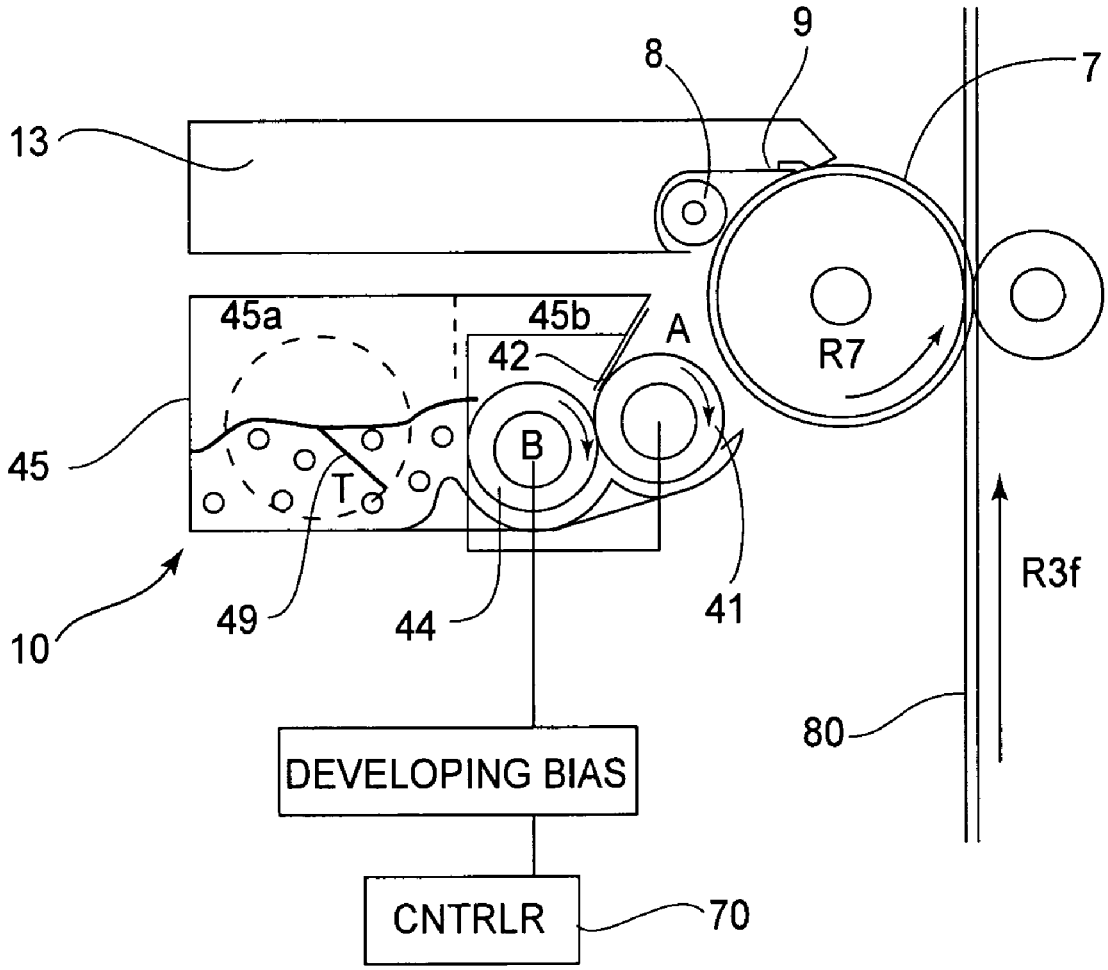
FIG. 3 is a cross-sectional view of the developing apparatus and its adjacencies in the first embodiment.

As will be evident from FIG. 3, the developing device 10 in this embodiment contains nonmagnetic single-component developer T (developer), which tends to become negatively charged. More specifically, the developer T is stored in the developer container 45*a* of the developing means container (frame of developing device). The developing device 10 is provided with a developer conveying member 49, which is disposed in the developer container 45*a*. The developing device 10 is also provided with a development sleeve 41 as a developer bearing member, a supply roller 44 as a developer supplying means for supplying the developer bearing member with developer, a development blade 42 as a developer regulating member, etc., which are disposed in the development chamber 45*b* of the developing means container 45, which constitutes the photosensitive drum side of the developing means container 45.

The developer conveying member 49 conveys the developer T toward the development chamber 45*b* so that the supply roller 44, that is, one of the developer supplying means, which is rotatably disposed in the development chamber 45*b*, is provided with the developer T. The supply roller 44 is in contact with the development sleeve 41, and rotates while maintaining a preset amount of peripheral velocity relative to the development sleeve 41 (in this embodiment, development sleeve 41 is rotated in such a direction that its peripheral surface moves in the direction indicated by arrow mark A in drawing, in the contact area between development sleeve 41 and supply roller 44, whereas supply roller 44 is rotated in such a direction that its peripheral surface moves in the direction indicated by arrow mark B in drawing, that is, opposite direction to direction indicated by arrow mark A, in contact area), so that after the developer T is conveyed from the developer container 45*a* to the development chamber 45*b*, it is coated on the development sleeve 41.

After being coated on the development sleeve 41, the body of the developer T is regulated in thickness by the development blade 42; it is formed into a thin layer of developer T with a preset thickness. The development sleeve 41, on which the layer of developer T has just been formed, is rotating while maintaining a preset amount of difference in peripheral velocity relative to the photosensitive drum 7 which it opposes.

The photosensitive drum 7 and development sleeve 41 are disposed so that a preset amount of gap is maintained between the two. Thus, the developer T on the development sleeve 41 jumps across the abovementioned gap (SD gap) to develop the electrostatic latent image on the photosensitive drum 7. In other words, the gap between the photosensitive drum 7 and development sleeve 41 is set to a value greater than the thickness of the developer layer on the development sleeve 41. In order to force the developer to jump, a development bias V is applied to the development sleeve 41.

Figure 4:
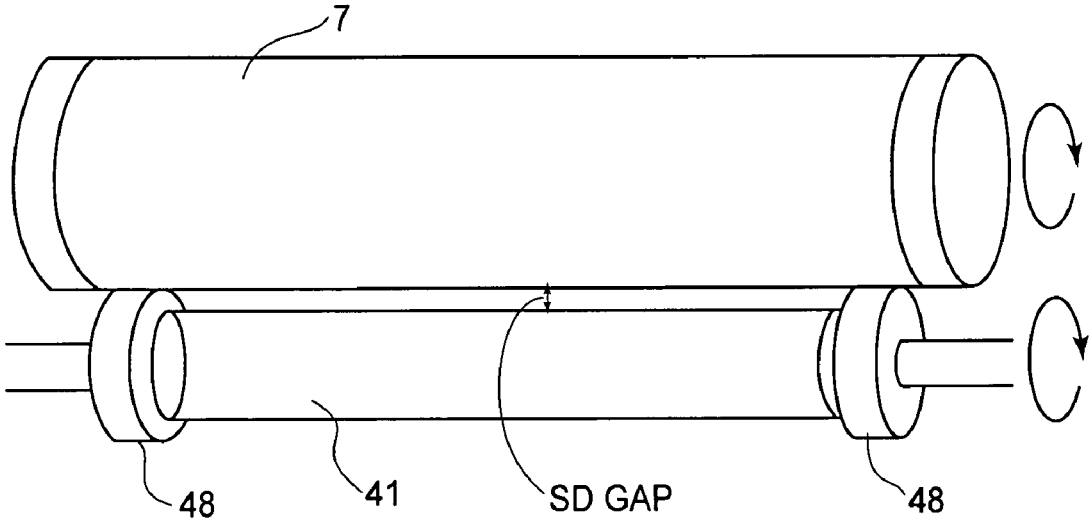
FIG. 4 is a schematic perspective view of the developing apparatus in the first embodiment.

Incidentally, each of the lengthwise end portions of the development sleeve 41 is fitted with a ring 48, the internal surface of which is in contact with the development sleeve 41, and the external surface of which is in contact with the photosensitive drum 7, so that a preset amount of gap is maintained between the peripheral surfaces of the development sleeve 41 and photosensitive drum 7. These rings 48 are formed of organic high polymer, such as POM, which is high in slipperiness and relatively small in the amount of compression deformation. These rings 48 for maintaining the abovementioned gap are rotatably fitted around the development sleeve 41. They are larger in diameter than the development sleeve 41, and are kept in contact with the photosensitive drum 7 with the application of pressure to maintain the preset amount of gap between the development sleeve 41 and photosensitive drum 7. FIG. 4 is a perspective view of the developing device 10. In this embodiment, the image forming apparatus is structured so that 300 μm of gap is maintained between the peripheral surfaces of the development sleeve 41 and photosensitive drum 7 by the abovementioned pair of rings 48.

The development sleeve 41 is 15 mm in diameter, and is made up of an aluminum cylinder, and a resin layer formed on the peripheral surface of the aluminum cylinder by coating the peripheral surface of the aluminum cylinder with a solution formulated by dispersing carbon or the like into the solution of resin to reduce the intended resin layer in electrical resistance. The choice of development sleeve does not need to be limited to the development sleeve 41 in this embodiment. In other words, it is optional to employ, as the development sleeve 41, one of the rollers which are suitable in elasticity and electrical resistance for the usage of a jumping developing method and nonmagnetic single-component developer. For example, a metallic roller, the peripheral surface of which is coated with urethane, may be employed. As for the material with which the peripheral surface of the development sleeve 41 is coated, such materials as silicon rubber, NBR, hydrin rubber, Nylon, fluorinated resin, etc., that are used as the material for the surface layer of a development sleeve which is used by an ordinary contact developing method, may be used in place of urethane. Those materials are used as binder for the various particles to be coated on the peripheral surface of the development sleeve to adjust the development sleeve in surface roughness, and also, as binder for various charge control agents.

In a developing operation, oscillating voltage, that is, the combination of DC voltage (development bias), and AC voltage which is sinusoidal in waveform, is applied to the development sleeve 41. The DC voltage is the same in polarity as the polarity (which is negative in this embodiment) to which the toner particles are charged; the DC voltage is −400 V. As the development bias is applied to the development sleeve 41, an alternating electric field is formed between the development sleeve 41 and photosensitive drum 7. This electric field causes the single-component developer to adhere to the exposed points of the electrostatic latent image on the peripheral surface of the photosensitive drum 7. In other words, the electrostatic latent image on the photosensitive drum 7 is reversely developed into a visible image formed of developer (toner). It is desired that the peak-to-peak voltage of the oscillating voltage as the development bias is set to such a value that not only is an alternating electric field induced between the dark points of the electrostatic latent image and the development sleeve, but also, between the light points of the electrostatic latent image and the development sleeve.

The development bias is applied from a development bias power source as a first voltage applying means. The application of the development bias is controlled by the controller 70. In order to achieve a satisfactory level of image density, the peripheral velocities of the photosensitive drum 7 and development sleeve 41 are set to 50 mm/sec and 75 mm/sec, respectively, so that the development sleeve 41 rotates at roughly 170% of the process speed, which is equivalent to the peripheral velocity of the photosensitive drum 7.

For the purpose of satisfactorily coating the developer T on the peripheral surface of the development sleeve 41, it is desired that a roller having sponge-like characteristics is employed as the supply roller 44. In this embodiment, the supply roller 44 is made up of an electrically conductive metallic core formed of stainless steel, and a layer of foamed rubber formed on the peripheral surface of the metallic core. The foamed rubber layer is 5 mm in thickness and $10^6$ Ω·cm in volume resistance. As the material for the foamed rubber, urethane, silicon rubber, and the like are preferable.

In a developing operation, −400 V of development bias (combination of DC and AC biases), which is identical in polarity (which is negative in this embodiment) to the toner particles used for development, is applied to the supply roller 44.

To the development sleeve 41, an oscillating voltage as the development bias which is −400 V in average voltage (DC component), 3 kHz in frequency, 1.8 kV (Vpp) in peak-to-peak voltage, 50% in duty ratio, and rectangular in waveform is applied. With the application of this development bias, an alternating electric field is induced between the dart points (−500 V in potential level) of the peripheral surface of the photosensitive drum 7 and the development sleeve 41, and between the light points (−120 V in potential level) of the peripheral surface of the photosensitive drum 7 and the development sleeve 41.

In this embodiment, the supply roller bias is controlled by the controller 70, and is applied from the development bias power source. It is the same in potential level as the development bias.

The development blade 42 is a 0.1 mm thick elastic plate, which is in the form of a belt and is formed of stainless steel. It is disposed so that the surface of its functional edge (free edge) portion contacts the peripheral surface of the development sleeve 41. It is tilted so that the functional edge portion is on the upstream side of its base portion, in terms of the rotational direction of the development sleeve 41. In other words, the development blade 42 is of the so-called counter type. The material for the development blade 42 does not need to be limited to stainless steel. That is, the choice of the material for the development blade 42 is optional; any substance which is appropriate in electrical conductivity may be employed. The development blade 41 regulates the thickness (height) of the layer formed on the peripheral surface of the development sleeve 41, regulating thereby the amount by which the developer is borne on the development sleeve 41; one or two thin layers of developer are formed on the peripheral surface of the development sleeve 41 by the development blade 42.

Next, the development bias which is applied to each development sleeve 41 in the developing apparatus 10 of each of the image formation stations Y, M, C, and Bk will be described. This development bias is what characterizes the present invention.

As described in Related Art Section, it has been discovered that if the same development bias is used for all of the yellow (Y), magenta (M), cyan (C) and black (Bk) image formation stations of an image forming apparatus structured so that all of its four photosensitive drums are charged to −500 V by its four charge rollers 8, one for one, which are connected to a single high voltage DC power source, and latent images are developed by a jumping developing method which uses non-magnetic single-component developer, the image forming apparatus cannot form an image which is satisfactory in image density (uniformity in image density).

The tests carried out in an ambience in which temperature and humidity are normal (24° C./60%), in order to study the relationship between the frequency of the development bias and image density in each of the image formation stations Y, M, C, and Bk, yielded the following results given in Table 2.

TABLE 2

| | | Color | | | |
|---|---|---|---|---|---|
| | | Y | M | C | Bk |
| Freqs. | 2 | N | N | N | F |
| | 2.25 | N | N | N | F |
| | 2.5 | N | F | N | G |
| | 2.75 | F | F | N | E |
| | 3 | G | F | N | E |
| | 3.25 | E | G | N | E |
| | 3.5 | E | E | N | F |
| | 3.75 | F | E | F | F |
| | 4 | N | E | G | N |
| | 4.25 | N | F | E | N |
| | 4.5 | N | N | E | N |
| | 4.75 | N | N | F | N |
| | 5 | N | N | N | N |

Legend for image density level:
E: no problem at all in density uniformity
G: slight problem in density uniformity is detectable
F: problem in density uniformity is detectable, although not problematic in practical terms
N: problem in density uniformity is conspicuous, being problematic in practical terms:

The examination of the results of the abovementioned tests revealed that adjusting the frequency of the development bias for each image formation station, according to the properties of each image formation station, independently from those for the other image formation stations creates the following problems.

That is, reducing the image forming apparatus in size reduces the distance between the development sleeve and charge roller in each image formation station. If the distance between the development sleeve and charge roller is smaller than a certain value, the AC component of the development bias applied to a given image formation station induces alternating current in the circuit of the charging apparatus of the image formation station. In other words, the AC component of the development bias is added as noise to the DC voltage as charge bias.

As the alternating current is induced in the charging apparatus by the AC component of this development bias, the photosensitive drum is slightly disturbed by this alternating current, that is, the pseudo charge bias, or noises. As a result, an image suffering from the moire attributable to the frequency of the development bias is formed.

According to the present invention, in order to prevent the formation of the abovementioned image which suffers from the moire attributable to the AC component of the development bias applied to each of the image formation stations, the four image formation stations are rendered practically identical in the frequency of the AC component of the development bias applied to induce the oscillating electric field in the image formation station, but are rendered different in the peak-to-peak voltage of the AC component of the development bias applied to the image formation stations.

In this embodiment, a value, to which the frequency of the AC component of the development bias for all the image formation stations is set, is selected in the range in which an image suffering from defects is not formed, and in which the error attributable to the performance of the circuit board for generating the AC component of the development bias is within 3%.

Next, the method, in this embodiment, for rendering the four image formation stations different in the peak-to-peak voltage of the AC component of the development bias applied to the image formation station, in consideration of the toner characteristics related to the density levels at which four monochromatic images different in color are outputted, while keeping the four image formation stations the same in the frequency of the AC component of the development bias, will be described.

As the common value to which the frequency of the AC component of the development bias for each image formation station is set, such a value that enables the image formation stations to be balanced in terms of the density level at which an image is outputted is selected. In this embodiment, 3.5 kHz is selected as the common value for the frequency for the AC component of the development bias applied to each of the four image formation stations.

Hereafter, the method for adjusting the peak-to-peak voltage of the AC component of the development bias applied to each image formation station, according to the properties of each image formation station, independently from those for the other image formation stations, will be described.

Figure 5:
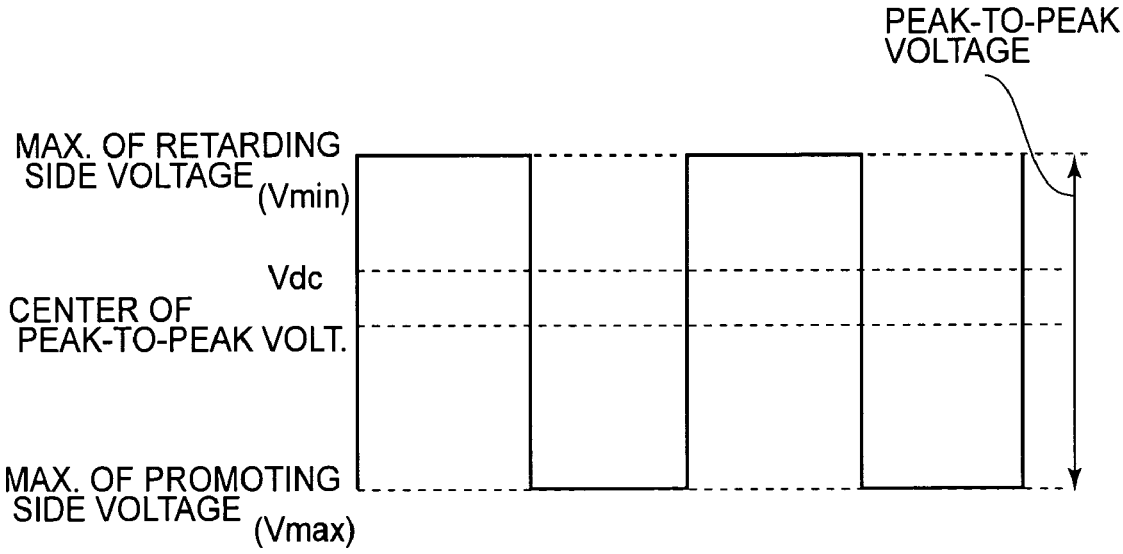
FIG. 5 is a diagrammatic drawing showing the AC voltage as development bias in the first embodiment.

Referring to FIG. 5, the amount of the difference between the maximum value of the AC component of the development bias, on the development retardation side, that is, on the positive side in terms of the waveform (which is rectangular) of the AC component, and the maximum value of the development promotion side, is the peak-to-peak voltage (Vpp).

The studies regarding the relationship between the maximum value of the AC component of the development bias, on the development promotion side, and the potential level (V1) of the light point voltage, revealed that the stronger the electric field, the better the image in reproducibility of the density level of the image portions.

As for the relationship between the maximum value of the AC component of the development bias, on the development promotion side, and the image density, the greater the former, the higher the latter. However, the relationship between the maximum value of the AC component of the development bias, on the development retardation side, and the image density, is such that the greater the former, the lower the latter.

It was also revealed that if the value of the AC component of the development bias, at a point which corresponds to the peak of the development promotion side of the waveform of the development bias is increased beyond the abovementioned maxim value, developer is adhered to even the theoretical white points of an image, which correspond to the unexposed points of the peripheral surface of the photosensitive drum an image. Hereafter, this phenomenon is referred to as fogging. Generally, as the maximum value of the development promotion side of the development bias is further increased, the condition in which satisfactory images cannot outputted is created; the condition in which fogging occurs is created.

It is evident from the preceding description of this embodiment that the density level at which an image is outputted can be controlled by controlling the peak-to-peak voltage of the AC component of the development bias applied to each image formation station.

In order to confirm the advantage of the present invention, the relationship between the image density and the occurrence of fogging was evaluated by carrying out tests in which the peak-to-peak voltage of the AC component of the development bias applied to the development sleeve of each image formation unit is set according to the characteristics of the image formation unit, independently from those for the other image formation stations.

The results of the abovementioned evaluations will be described with reference to Tables 3 and 4.

TABLE 3

Table 3: Relationship between peak-to-peak voltage in each image formation station, and density level of image outputted by image formation station:

| | | Color | | | |
|---|---|---|---|---|---|
| | | Y | M | C | Bk |
| Vpp (kV) | 1.5 | F | N | N | N |
| | 1.55 | G | F | N | N |
| | 1.6 | E | G | N | N |
| | 1.65 | E | E | N | N |
| | 1.7 | E | E | N | F |
| | 1.75 | E | E | F | F |
| | 1.8 | E | E | G | E |
| | 1.85 | E | E | E | E |
| | 1.9 | E | E | E | E |

Legend for image density level:
E: no problem at all in density uniformity
G: slight problem in density uniformity is detectable
F: problem in density uniformity is detectable, although not problematic in practical terms
N: problem in density uniformity is conspicuous, being problematic in practical terms.

TABLE 4

Table 4: Relationship between Vpp for each image formation station, and fog of image outputted by image formation station:

| | | Color | | | |
|---|---|---|---|---|---|
| | | Y | M | C | Bk |
| Vpp (kV) | 1.5 | E | E | E | E |
| | 1.55 | E | E | E | E |
| | 1.6 | E | E | E | E |
| | 1.65 | E | E | E | E |
| | 1.7 | E | E | E | E |
| | 1.75 | G | E | E | E |
| | 1.8 | F | E | E | E |
| | 1.85 | N | F | E | F |
| | 1.9 | N | N | F | N |

Legend for fog level:
E: no problem (no fog at all)
G: small amount of fog is detectable
F: fog is detectable, although not problematic in practical terms
N: fog is conspicuous, being problematic in practical terms The examinations of the results of the above described tests revealed the following. The value for the peak-to-peak voltage of the AC component of the development bias, which enables the image formation stations Y and M to reliably form an image with a desired density, was 1.7 kV (Vpp=1.7 kV), and the value for the peak-to-peak voltage of the AC component of the development bias, which enables the image formation station C to reliably form an image with a desired density, was 1.85 kV (Vpp=1.85 kV). Further, the value for the peak-to-peak voltage of the AC component of the development bias, which enables the image formation stations Bk to reliably form an image with a desired density, was 1.8 kV (Vpp=1.8 kV).

As described above, in this embodiment, the four image formation stations were rendered identical in the frequency of the AC component of the development bias, whereas they were rendered different in the peak-to-peak voltage of the AC component of the development bias. With the employment of this arrangement, it became possible to stabilize the four image formation stations in the density level at which images were outputted. Therefore, it became possible to prevent the formation of an image suffering from the moire attributable to the disturbance of the potential level of the peripheral surface of the photosensitive drum, which was traceable to the development bias for each image formation station.

Also with the employment of the above described structural arrangement, it is possible for each image formation station to be individually adjusted in the peak-to-peak voltage of the development bias applied to its developing apparatus. Therefore, it is possible to prevent each image formation station from decreasing in the image density level at which it outputs an image, making it possible to yield a multicolor image which is excellent in color balance.

Also with the employment of the above arrangement, it is possible to eliminate the need for increasing an image forming apparatus in size, preventing thereby cost increase, while making it possible to provide an image forming apparatus capable of reliably forming a high quality image, that is, shape and vivid image, regardless of ambient conditions.

The above described structural arrangement is very effective when the image forming apparatus is in the initial stage of its service life, and is used in an ambience in which temperature and humidity are normal. However, generally, the toner in each color station changes in characteristics in response to its ambient condition and the cumulative number of images formed by the station (cumulative length of its usage). In this embodiment, therefore, the level of density at which an image is outputted is controlled by adjusting the peak-to-peak voltage of the development bias applied to each image formation station, independently from those applied to the other image formation stations, according to its ambient condition and the cumulative number of images outputted by the image formation station.

In this embodiment, the following three ambient conditions were selected as the ambient conditions to be detected. The ambient condition which is 24° C. and 60% in temperature and relative humidity, respectively, was selected as the ambient condition which is normal in temperature and relative humidity, and the ambient condition which is 15° C. and 10% in temperature and relative humidity, respectively, was selected as the ambient condition which is low in temperature and relative humidity. Further, the ambient condition which are 30° C. and 80% in temperature and relative humidity, respectively, was selected as the ambient condition which is high in temperature and relative humidity.

In this embodiment, the durability of each image formation unit was assumed to be 2,000 copies, in terms of cumulative number of copies producible by the image formation unit. The AC component of the development bias for each image formation unit was adjusted every 500 copies.

Figure 6:
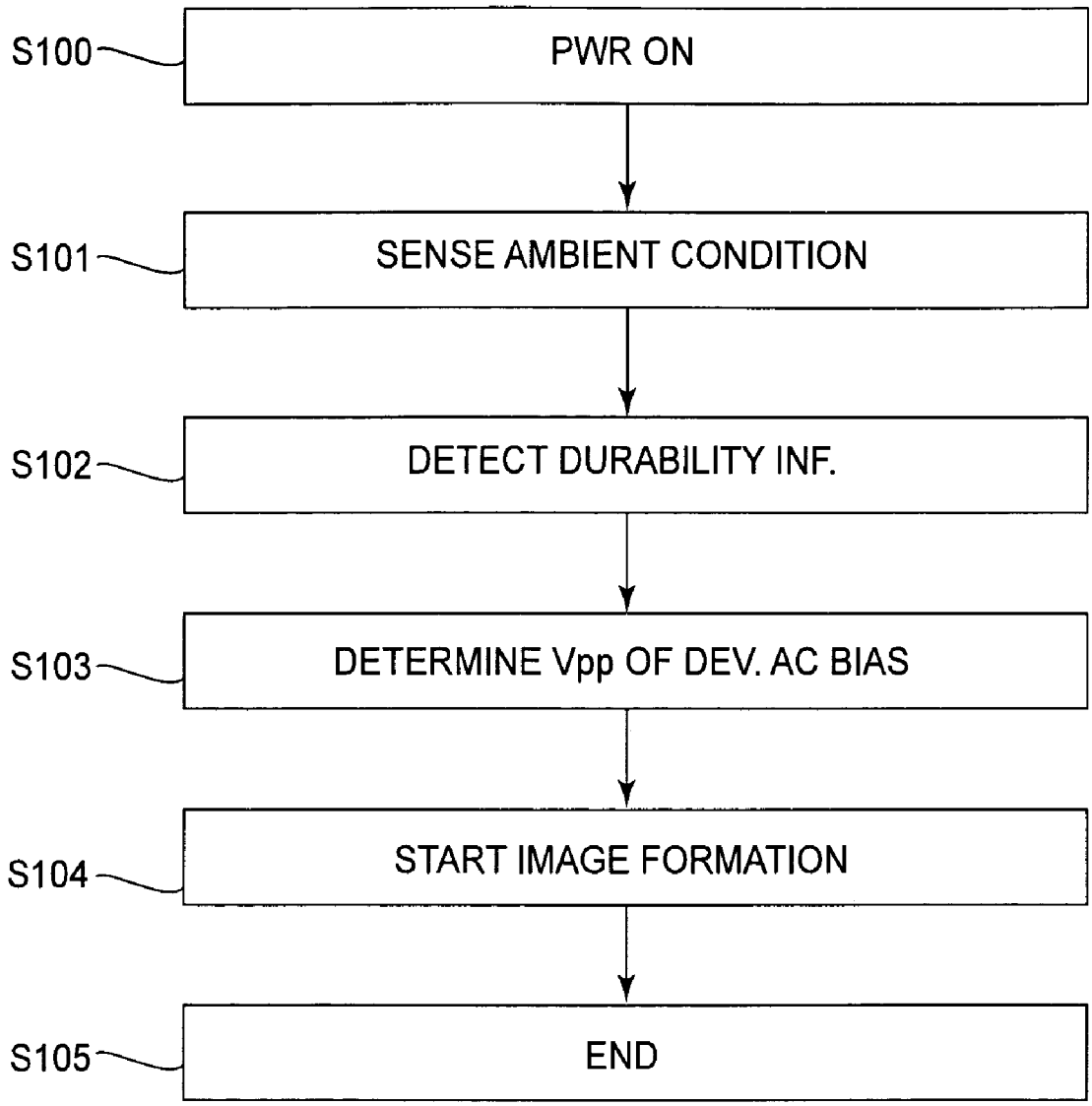
FIG. 6 is a flowchart of the operation of the image forming apparatus in the first embodiment.

FIG. 6 is a flowchart of the operation of the image forming apparatus 100 in this embodiment.

First, the electric power source of the charge roller is turned on (S100). Next, the conditions of the ambiences of the image formation stations are detected by the temperature/humidity sensor 90 (S101). Then, the information regarding the cumulative number of images formed by each image formation unit (process cartridge), which is in the storage means 60 is detected (S102). Then, the value for the peak-to-peak voltage of the AC component of the development bias to be applied to the development sleeve is selected (S103). Then, the image forming operation is started (S104). The operation is ended as intended images are outputted (S105). It is desired to provide each image formation unit with its own storage means 60 as a memory.

For comparison, tests carried out in which images were formed without adjusting the AC component of the development bias for each image formation unit, independently from those for the other image formation units; that is, the same development bias (−400 V in average voltage (DC component), 3 kHz in frequency, 1.8 kV in peak-to-peak voltage, and rectangular in wave form) was applied to all the image formation units. In this embodiment, the peak-to-peak voltage of the AC component of the development bias for each image formation unit was adjusted in response to the ambient conditions and the cumulative number of images formed by the image formation unit, independently from those for the other image formation units, in order to form an image which is satisfactory in image density and suffers no fog. The images formed under the comparative image formation control, and those formed under the image formation control in this embodiment, are comparatively examined. The results are given in the following tables.

Given in Table 5 are the results of the examinations of the conditions for the development bias, which enabled the image forming apparatus to form images which were satisfactory in image density and do not suffer from fog, in the low temperature/low humidity ambience.

TABLE 5

Table 5: Relationship between cumulative number of images and values to which Vpp was set, in low temperature/low humidity ambience:

| | | Color | | | |
|---|---|---|---|---|---|
| | | Y | M | C | Bk |
| | | Comp. Example | | | |
| Nos. of Sheets | 0 | 1.7 | 1.7 | 1.85 | 1.8 |
| | 500 | 1.7 | 1.7 | 1.85 | 1.8 |
| | 1000 | 1.7 | 1.7 | 1.85 | 1.8 |
| | 1500 | 1.7 | 1.7 | 1.85 | 1.8 |
| | 2000 | 1.7 | 1.7 | 1.85 | 1.8 |
| | | Embodiments | | | |
| Nos. | 0 | 2 | 2 | 2.25 | 2.1 |
| | 500 | 1.95 | 1.95 | 2.15 | 2.1 |
| | 1000 | 1.9 | 1.9 | 2.1 | 2.05 |
| | 1500 | 1.85 | 1.85 | 2.05 | 1.95 |
| | 2000 | 1.8 | 1.8 | 2 | 1.9 |

The results of the examinations of the relationship between the AC component (values of peak-to-peak voltage) of the development bias, and the resultant images, are given in Table 6.

TABLE 6

Table 6: Relationship between Vpp for each image formation station and the images formed in low temperature/low humidity ambience:

| | | Color | | | |
|---|---|---|---|---|---|
| | | Y | M | C | Bk |
| | | Comp. Example | | | |
| Nos. of Sheets | 0 | N | N | N | N |
| | 500 | F | F | N | N |
| | 1000 | F | F | N | N |
| | 1500 | F | F | F | F |
| | 2000 | F | F | F | F |
| | | Embodiments | | | |
| Nos. | 0 | E | E | E | E |
| | 500 | E | E | E | E |
| | 1000 | E | E | E | E |
| | 1500 | E | E | E | E |
| | 2000 | E | E | E | E |

Legend for image density and fog,
E: no problem
G: small amount of problem is detectable
F: problem is detectable, although not problematic in practical terms
N: problem is conspicuous, being problematic in practical terms Given in the following table (Table 7) are the relationship between the cumulative number of images and the values of the peak-to-peak voltage of the AC component of the development bias, which makes it possible to form an image which is satisfactory in density and suffers no fog, in the high temperature/high humidity ambience.

TABLE 7

Table 7: Relationship between cumulative number of images and Vpp, in high temperature/high humidity ambience:

| | | Color | | | |
|---|---|---|---|---|---|
| | | Y | M | C | Bk |
| | | Comp. Example | | | |
| Nos. of Sheets | 0 | 1.7 | 1.7 | 1.85 | 1.8 |
| | 500 | 1.7 | 1.7 | 1.85 | 1.8 |
| | 1000 | 1.7 | 1.7 | 1.85 | 1.8 |
| | 1500 | 1.7 | 1.7 | 1.85 | 1.8 |
| | 2000 | 1.7 | 1.7 | 1.85 | 1.8 |
| | | Embodiments | | | |
| Nos. | 0 | 1.6 | 1.6 | 1.75 | 1.7 |
| | 500 | 1.6 | 1.6 | 1.75 | 1.7 |
| | 1000 | 1.6 | 1.6 | 1.75 | 1.7 |
| | 1500 | 1.55 | 1.55 | 1.7 | 1.65 |
| | 2000 | 1.5 | 1.5 | 1.65 | 1.6 |

The results of the examination of the relationship between the AC component (values of peak-to-peak voltage) of the development bias, and the resultant images, are given in Table 8.

TABLE 8

Table 8: Relationship between Vpp for each image formation station and the images formed in high temperature/high humidity ambience:

| | | Color | | | |
|---|---|---|---|---|---|
| | | Y | M | C | Bk |
| | | Comp. Example | | | |
| Nos. of Sheets | 0 | N | N | N | N |
| | 500 | F | F | N | N |
| | 1000 | F | F | N | N |
| | 1500 | F | F | F | F |
| | 2000 | F | F | F | F |
| | | Embodiments | | | |
| Nos. | 0 | E | E | E | E |
| | 500 | E | E | E | E |
| | 1000 | E | E | E | E |
| | 1500 | E | E | E | E |
| | 2000 | E | E | E | E |

Legend for image density and fog,
E: no problem
G: small amount of problem is detectable
F: problem is detectable, although not problematic in practical terms
N: problem is conspicuous, being problematic in practical terms Based on the above results, the peak-to-peak voltage of the AC component of the development bias is adjusted according to the condition of the ambience. In the low temperature/low humidity ambience, the amount by which the developer acquires electrical charge tends to be larger because of the characteristics of the developer. Therefore, in a low temperature/low humidity ambience, the peak-to-peak voltage is set high to increase the image density level at which an image is outputted. On the other hand, in a high temperature/high humidity ambience, the amount by which toner acquires electric charge tends to be relatively large because of tone characteristic. Therefore, in a high temperature/high humidity ambience, the peak-to-peak voltage is set low to prevent the formation of an image suffering from fog.

As for the adjustment for the changes in cumulative number of images, the peak-to-peak voltage was adjusted according to the toner characteristics and the cumulative number of images; it was set to the values, shown in Table 8, which were in the range in which an image which was abnormal in density and/or suffered from fog was not formed.

With the employment of the above described structural arrangement, the peak-to-peak voltage of the development bias for each image formation station can be adjusted according to the condition of the image formation station, independently from those for the other image formation stations, making it possible to better prevent each image formation station from decreasing in the level of image density at which it forms an image. Therefore, it is possible to obtain a multicolor image which is excellent in color balance.

Figure 7:
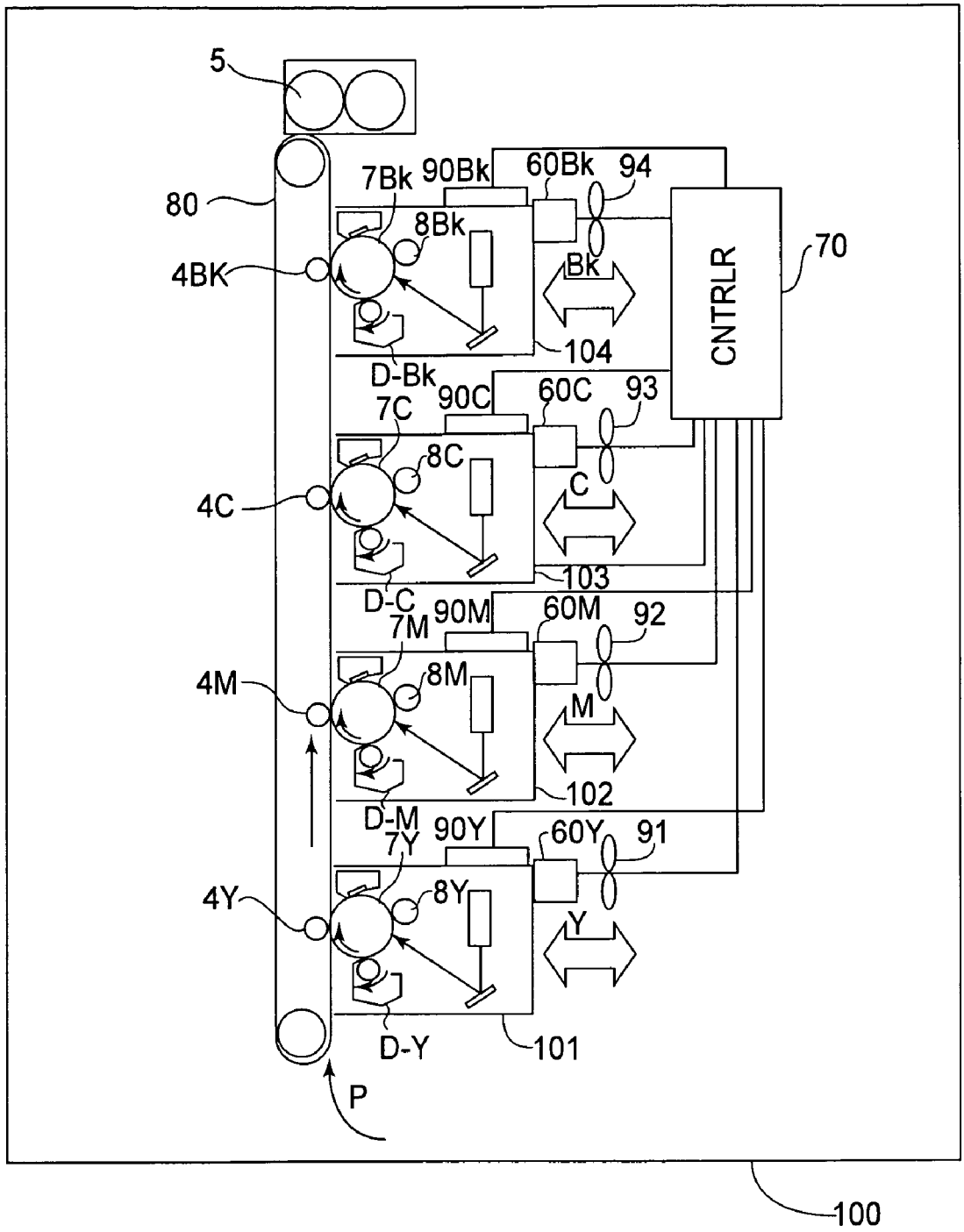
FIG. 7 is a schematic sectional view of the image forming apparatus, in the first embodiment of the present invention, in which all of the four process cartridges have been mounted.

Referring to FIG. 7, in this embodiment, the photosensitive drum 7 (7Y, 7M, 7C, and 7), charge roller 8 (8Y, 8M, 8C, and 8Bk), and cleaning apparatus are integrated into a photosensitive drum unit. Further, each photosensitive drum unit and the developing apparatus D (D-Y, D-M, D-C, and D-Bk) are integrated into a process cartridge (which hereinafter will be referred to as "cartridge") 101 (101-104), which is removably mountable in the image forming apparatus 100.

Further, each of the cartridges 101-104 is provided with the storage means 60 (60Y, 60M, 60C, and 60Bk). These storage means 60Y, 60M, 60C, and 60Bk are connected to the controller 70 by the connective devices 91-94, respectively, as the cartridges 101-104 are mounted into the charge roller. The storage means 60Y, 60M, 60C, and 60Bk are used for storing the cumulative number of images formed prior to the post-rotation.

Further, the image forming apparatus in this embodiment shown in FIG. 7 is provided with the temperature/humidity sensors 90 (90Y, 90M, 90C, and 90Bk) as ambient condition detecting means for detecting the temperature and humidity of the ambience, which are disposed in the adjacencies of the photosensitive drums 7Y, 7M, 7C, and 7Bk, detecting thereby the ambient temperature and humidity of the photosensitive drums 7Y, 7M, 7C, and 7Bk, respectively.

Therefore, it does not occur that information such as the condition of the ambience in which the cartridges 101-104 were used, the cumulative number of images formed by each cartridge, etc., is lost when the cartridges 101-104 are removed from the charge roller during a printing operation. In other words, the provision of the temperature/humidity sensors 90 are effective to ensure the above described objects of the present invention are achieved.

As described above, according to this embodiment, the usage history of each of the cartridges 101-104 is stored in storage means 60 (60Y, 60M, 60C, and 60Bk). Therefore, a proper value can be selected for the peak-to-peak voltage of the AC component of the development bias with proper timing. Therefore, it is possible to obtain an image with a proper level of density.

Further, even if a given cartridge, which has been used in the image forming apparatus 100, is removed from the apparatus 100, and is mounted into another image forming apparatus (100), the ambient temperature and humidity of the photosensitive drum in this cartridge are precisely measured, making it possible to set the peak-to-peak voltage of the AC component of the development bias to a proper value with proper timing. Therefore, it is possible to obtain an image with a proper level of image density.

Embodiment 2

Next, referring to FIG. 8, the second embodiment of the present invention will be described.

The structure of the image forming apparatus in this embodiment is identical to that in the first embodiment. Therefore, it will not be described here, and only the method for optimizing the AC component of the development bias when forming an image, that is, the method for adjusting the frequency at which the developer jumps between the photosensitive drum and development sleeve, on the upstream side of the contact area between the photosensitive drum and development sleeve in terms of the moving direction of the peripheral surfaces of the photosensitive drum and development sleeve, will be described.

In this embodiment, the formation of an image suffering from the moire attributable to the phenomenon that the photosensitive drum in a given image formation station is disturbed in the potential level of its peripheral surface by the development bias for the image formation station, is prevented by generating, as development bias applied to the development sleeve, an AC voltage, the waveform of which has portions which generate an oscillating electric field, and portions which do not generate an oscillating field, and in which the portion which generates an oscillating electric field and the portion which does not generate an oscillating electric field are alternately positioned to stabilize the image formation station in the image density level at which an image is outputted.

Next, referring to FIG. 8, the oscillating voltage as the development bias, which is made up of the portions which induce an alternating electric field (portions which change in potential level), and the portions which does not induce an alternating electric field (portions which do not change in potential level), and in which the former and the latter are alternately positioned, will be described. This development bias is referred to as blank pulse.

Figure 8:
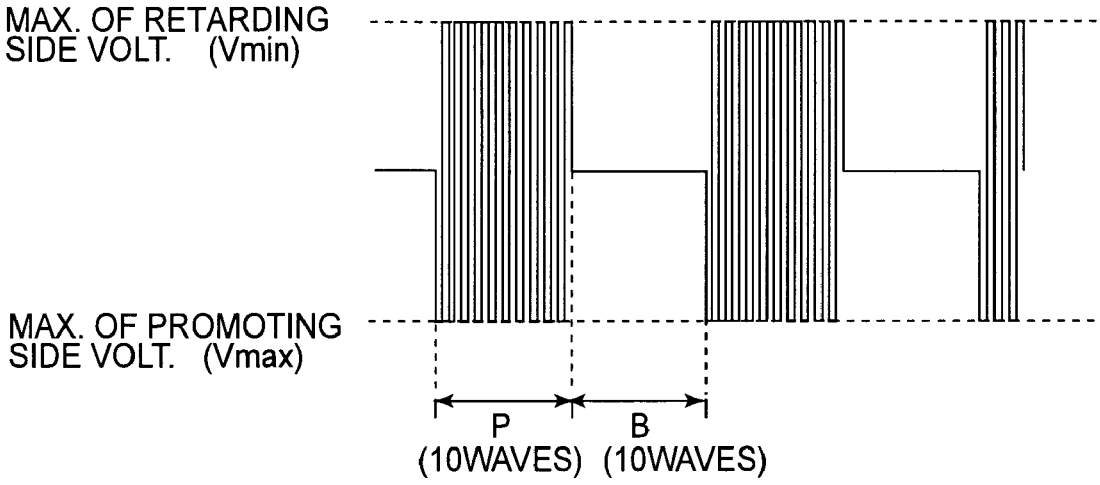
FIG. 8 is a diagrammatic drawing showing the AC voltage as the development bias in the second embodiment of the present invention.
Figure 9:
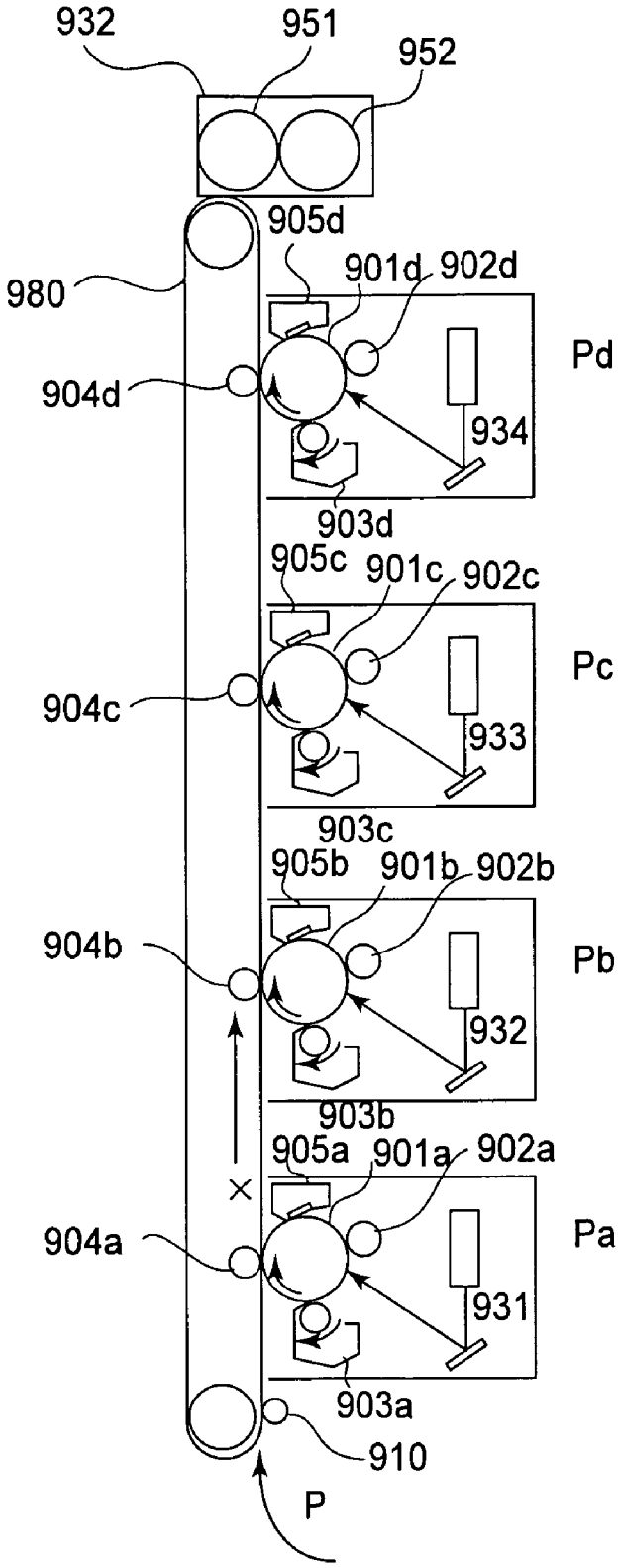
FIG. 9 is a schematic sectional view of an image forming apparatus in accordance with the prior art.

As will be evident from FIG. 8, in terms of waveform, the oscillating electric field applied to each development sleeve has pulse waveform portions P (oscillating portions), in which the voltage changes in potential level, and blank portions B in which the voltage does not change in potential level. The durations of each oscillating portion P and each blank portion B are equivalent to 10 pulses. Hereafter, this kind of oscillatory electric field will be referred to as 10/10 BP (blank pulse made up of pulse waveform portion, duration of which is equivalent to 10 pulses, and blank portions, duration of which is equivalent to 10 pulses).

In this embodiment in which the blank pulse is used as the AC component of the development bias, the frequency of each oscillating portion of the blank pulse for each image formation station is rendered identical to those for the other image formation stations.

Also in this embodiment, a single value which is excellent in terms of the balance among the density levels at which images are outputted by the image formation stations is selected as the value for the frequency of the oscillating portion of the blank pulse for all the image formation stations. This value in this embodiment is 3.5 kHz. As for the peak-to-peak voltage, it is kept constant at 1.7 kV.

These parameters are adjusted to control the density level at which an image is outputted:

For the purpose of increasing the density level, the oscillating portion P is increased in ratio;

For the purpose of decreasing the density level, the blank portion B is increased in ratio.

In order to confirm the advantages of this embodiment, tests, in which the blank pulse applied to the development sleeve of each of the image formation units different in the color of the monochromatic images they form was adjusted according to the properties of each image formation unit, were carried out in the high temperature/high humidity ambience. The results were evaluated using the same criteria as those described in the sections of this document describing of the first embodiment; the criteria used for evaluating the image density levels are the same as those used for evaluation of the results of the aforementioned tests.

Next, the results of the abovementioned examinations will be described with reference to Tables 9 and 10.

TABLE 9

Table 9: Relationship between blank pulse applied to each image formation station and image density of images outputted by each image formation station:

| | | Color | | | |
|---|---|---|---|---|---|
| | | Y | M | C | Bk |
| Pulse/ Blank | 10/20 | N | N | N | N |
| | 7/13 | N | N | N | N |
| | 8/12 | F | F | N | N |
| | 10/10 | G | G | N | N |
| | 12/8 | E | E | F | N |
| | 13/7 | E | E | G | F |
| | 20/10 | E | E | E | G |
| | 30/10 | E | E | E | E |
| | Rectangular | E | E | E | E |

TABLE 10

Table 10: Relationship between blank pulse applied to each image formation station and fog prevention of images outputted by each image formation station:

| | | Color | | | |
|---|---|---|---|---|---|
| | | Y | M | C | Bk |
| Pulse/ Blank | 10/20 | E | E | E | E |
| | 7/13 | E | E | E | E |
| | 8/12 | E | E | E | E |
| | 10/10 | E | E | E | E |
| | 12/8 | E | E | E | E |
| | 13/7 | E | E | E | E |
| | 20/10 | G | G | E | E |
| | 30/10 | F | F | E | E |
| | Rectangular | N | N | E | E |

In the embodiment, the pulse ratios of 10/10, 12/8, 13/7 and so on are usable for the developing bias for Y and M development; the pulse ratios of 13/7, 20/10 and so on are usable for the developing bias for C development; and the pulse ratios of 20/10, 30/10 and so on are usable for the developing bias for Bk. However, depending on the conditions including the outer diameter of the developing sleeve, for example, optimum blank pulsation can be properly selected by one skilled in the art, and the blank pulsation is changed in each of the image forming stations, by which the advangeous effects of embodiment 1 can be provided.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 136688/2005 filed May 9, 2005 which is hereby incorporated by reference.

What is claimed is:

1. An image forming apparatus comprising:

a first image bearing member;

a first charger for electrically charging said first image bearing member;

a first developer carrying member for carrying a first color developer to develop an electrostatic image formed on said first image bearing member with the first color developer;

a first voltage source for applying a first oscillating voltage to said first developer carrying member;

a second image bearing member;

a second charger for electrically charging said second image bearing member;

a second developer carrying member for carrying a second color developer to develop an electrostatic image formed on said second image bearing member with the second color developer;

a second voltage source for applying a second oscillating voltage to said second developer carrying member;

a third voltage source for applying a common DC voltage to said first charger and to said second charger, wherein a frequency of said first oscillating voltage and a frequency of said second oscillating voltage are substantially the same.

2. An apparatus according to claim 1, wherein said first oscillating voltage and said second oscillating voltage are variable independently from each other.

3. An apparatus according to claim 2, wherein a peak-to-peak voltage of the first oscillating voltage and a peak-to-peak voltage of the second oscillating voltage are variable independently from each other.

4. An apparatus according to claim 1, wherein each of the first oscillating voltage and the second oscillating voltage alternating repeating varying portion in which a potential varies and constant portion in which a potential is substantially constant, and wherein a ratio between the varying portion and the constant portion in the first oscillating voltage and a ratio between the varying portion and the constant portion in the second oscillating voltage are variable independently from each other.

5. An apparatus according to claim 1, wherein the frequency of the first oscillating voltage is in a range of ±3% of the frequency of the second oscillating voltage.

6. An apparatus according to claim 1, wherein the first oscillating voltage and the second oscillating voltage are changed in accordance with a use condition of said image forming apparatus.

7. An apparatus according to claim 1, wherein said apparatus forms an image on a sheet, and wherein said first oscillating voltage and said second oscillating voltage are changed in accordance with a number of sheets on which images have been formed.

8. An apparatus according to claim 1, further comprising detecting means for detecting information relating to an ambient condition, wherein said first oscillating voltage and said second oscillating voltage are changed on the basis of an output of said detecting means.

9. An apparatus according to claim 1, wherein a gap is provided between said first image bearing member and said first developer carrying member and is larger than a thickness of a developer layer carried on said first developer carrying member, and a gap is provided between said second image bearing member and said second developer carrying member and is larger than a thickness of a developer layer carried on said second developer carrying member.

10. An apparatus according to claim 1, wherein said first charger is contactable to said first image bearing member, and said second charger is contactable to said second image bearing member.

* * * * *

UNITED STATES PATENT AND TRADEMARK OFFICE

CERTIFICATE OF CORRECTION

PATENT NO. : 7,403,726 B2
APPLICATION NO. : 11/429981
DATED : July 22, 2008
INVENTOR(S) : Masahiro Shibata It is certified that error appears in the above-identified patent and that said Letters Patent is hereby corrected as shown below:

TITLE PAGE, AT ITEM [30], Foreign Application Priority Data
"2005/136688" should read --2005-136688--.

COLUMN 3
Line 50, "capable" should read --capable of--.
Line 60, "on" should read --one--.

COLUMN 5
Line 49, "were the" should read --were--.

COLUMN 14
Line 50, "terms:" should read --terms.--.

COLUMN 16
Line 5, "cannot" should read --cannot be--.

COLUMN 20
Line 57, "and 7)," should read --and 7Bk),--.

Signed and Sealed this

Sixth Day of January, 2009

JON W. DUDAS
*Director of the United States Patent and Trademark Office*